United States Patent [19]

Kenkare et al.

[11] 4,122,976

[45] Oct. 31, 1978

[54] DISPENSING

[75] Inventors: Divaker B. Kenkare, South Plainfield; Clarence R. Robbins, Piscataway; John C. Carson, Jr., Mansaquan Park, all of N.J.

[73] Assignee: Colgate-Palmolive Company, New York, N.Y.

[21] Appl. No.: 741,097

[22] Filed: Nov. 11, 1976

[51] Int. Cl.[2] ..... B65D 35/22

[52] U.S. Cl. ..... 222/94

[58] Field of Search ..... 222/94

[56] References Cited

U.S. PATENT DOCUMENTS

| | | | |
|---|---|---|---|
| 2,935,231 | 5/1960 | Paull et al. | 222/94 |
| 3,240,393 | 3/1966 | Jablonski | 222/94 |
| 3,331,535 | 7/1967 | Jarvis | 222/94 |

*Primary Examiner*—Joseph F. Peters, Jr.
*Assistant Examiner*—Norman L. Stack, Jr.
*Attorney, Agent, or Firm*—Strauch, Nolan, Neale, Nies & Kurz

[57] ABSTRACT

A marbleized appearance is imparted to the column of paste or like material extruded from a flexible walled container by injecting material of a different color into a column of a predominantly base color passing through a container outlet lined with irregular projections.

5 Claims, 3 Drawing Figures

DISPENSING

This invention relates to the dispensing of gels, pastes, creams, and the like and particularly to dispensing of these compositions for imparting a marbleized appearance.

It has long been customary to dispense compositions of the foregoing nature from flexible walled tubes or other like containers. Efforts have been made to impart a distinctive or more attractive appearance to the dispensed composition. For some time, as disclosed in Marraffino U.S. Pat. No. 2,789,731, it has been proposed to dispense toothpaste and the like having a predominantly base color with distinctive stripes of another color. Also, it has been proposed to dispense pastes and the like of a predominantly base color containing discrete particles or flecks of contrasting color.

The present invention has for its major feature the dispensing of these compositions from flexible wall containers in the form of a column of a predominantly base color having at least on its outer surface random but distinctive streaks and/or areas of a different color that impart a marbleized appearance. The term color includes black and white.

Another feature of the invention is to provide a container of the flexible wall type wherein the bulk of the contents in paste, gel, cream or like form passes through the discharge outlet as a continuous column of a predominantly base color during dispensing with increments of material of a different color being injected into the column as it passes through the outlet, and wherein the outlet is lined with irregular projections causing uneven dispersion of the injected material so as to impart a marbleized appearance to the dispensed product.

Pursuant to the foregoing an important feature is to provide the projections on the inner surface of a tube projecting internally from the outlet, with the tube being apertured near the dispensing end of the container and surrounded in the apertured region by the material to be injected during dispensing.

Further features and advantages of the invention will appear as the description proceeds in connection with the appended claims and the annexed drawings.

PREFERRED EMBODIMENTS

Figure 3:
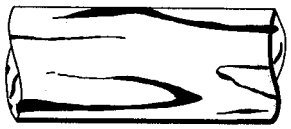
FIG. 3 is a stylized showing of the dispensed product.

The invention comprises a special dispensing system wherein two components of more or less contrasting color or equivalent appearance factor are co-dispensed in such fashion that the dispensed product has a marbleized appearance such as in FIG. 3.

Figure 1:
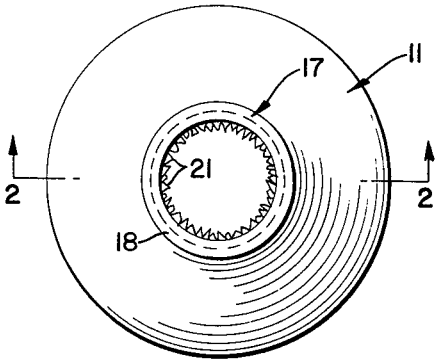
FIG. 1 is a top plan view of a container embodying the invention in a preferred form.
Figure 2:
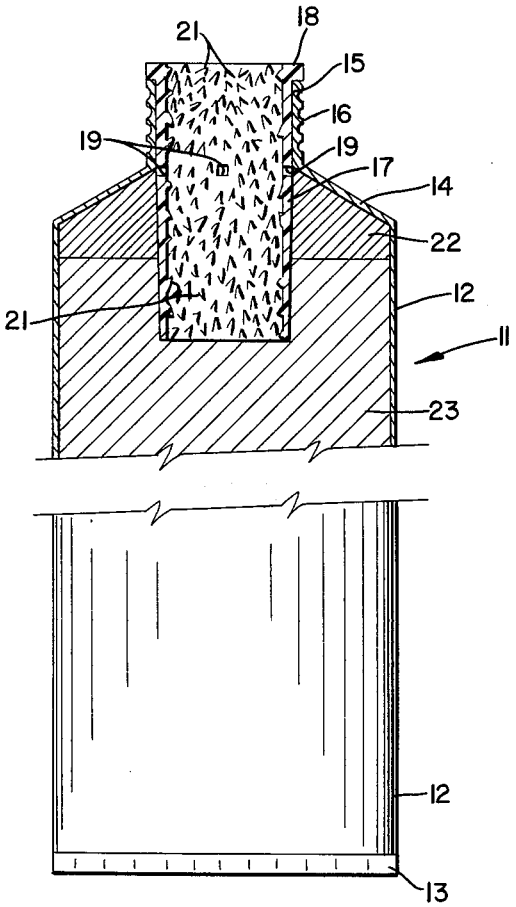
FIG. 2 is a section substantially on line 2—2 of FIG. 1 showing detail.

The container 11 of FIGS. 1 and 2 is for example the usual squeeze type having a flexible walled metal body 12 closed at the bottom by a crimped section 13 and formed at the top or dispensing end with a tapered shoulder 14 terminating in a reduced size cylindrical discharge neck 15 formed with external threads 16 for mounting the usual closure cap (not shown).

The interior of neck 15 may be smooth and adapted to receive with a force fit a hollow open ended generally cylindrical tube 17 having at its outer end an external ledge 18 adapted to seal on the end of neck 15. As shown tube 17 may be slightly tapered, reducing in size toward the inner end, for ease in assembly. In some embodiments tube 17 may be an integral internal projection from the container shoulder.

Tube 17 is formed with a series of lateral openings 19 usually arranged in a circular row and all disposed to open to the upper end of the space within the container at the dispensing end. As shown the inner end of tube 17 is open to the contents of the container well below the dispensing end.

The interior of tube 17 is formed with a multiplicity of irregularly and usually randomly distributed protrusions or projections 21. There is no critical form, size or spacing pattern for these projections although it may be found that certain groupings and arrangements produce preferred random marbleizing in the dispensed product.

In the invention the container is filled with a product such as a shampoo composition in gel, cream or similar fluent form. The container is filled from the bottom and the initial portion which contains the distinctive color relied upon for the contrast in the dispensed product is placed in the upper region of the container in surrounding relation to the openings 19, that space being arbitrarily shaded and designated at 22 in FIG. 2. The remainder of the body is then filled with the balance of the cream or gel, usually the same composition without the distinctive coloring agent, this space being arbitrarily designated at 23 in FIG. 2.

The spaces 22 and 23 are not particularly critical in proportion, although space 22 is usually of minor extent and located (in the upright position of FIG. 2) well above the lower end of tube 17.

The compositions in spaces 22 and 23 may differ only in color, or in addition may differ otherwise for added effects.

When the product is to be dispensed body 12 is squeezed thereby forcing the contents to flow in bulk from space 23 as a column through tube 17 and at the same time forcing or injecting relatively small streams of the differently colored contents of space 22 through openings 19 to join and admix with the column being extruded.

It has been found that, by providing the projections 19 on the interior of tube 17, the composition in the outer layers of the column passing from space 23 through tube 17 is imparted an uneven multi-directional movement, particularly at and near the outer surface such that the introduced streams of colored composition are broken up and randomly distributed and dispersed. This results in a dispensed product having a desired marbleized appearance as in FIG. 3.

The shape of tube 17, which may be rectangular or oval in cross-section for example, may be chosen to suit convenience or a special product. The internal diameter of tube 17 and the number and relative sizes of the openings 19 may be varied to suit effects desired. Usually it is preferred that by the time the last portions are being dispensed from space 23 axially through tube 17 the supply in space 22 may be exhausted.

Tube 17 is preferably an integral synthetic plastic element, and container 11 may be of metal, plastic or a lamination of metal and plastic.

The invention may be employed for the dispensing of marbleized hair creams, shave creams and dental creams and similar cosmetic products, as well as food creams and gels, for desired appearances.

Following is a typical example of practice of the invention. The color phase occupies space 22 of FIG. 2 while the non-color phase occupies space 23 of FIG. 2.

EXAMPLE

Component I Color Phase

| | | |
|---|---|---|
| | Sodium Lauryl sulfate (28.3%) | 62.300 |
| | Triethanol ammonium Lauryl Sulfate (40.1%) | 4.655 |
| | Deionized water | 16.350 |
| Part I | Anhydrous Lanolin - Odorless | 0.470 |
| | Methyl p-hydroxy benzoate | 0.140 |
| | Table salt | 1.350 |
| Part II | Stearic acid - grade A | 6.580 |
| | Koh caustic Potash (34.2%) | 4.898 |
| Part III | Deionized water | 0.122 |
| | Lauric/myristic Diethanolamide | 1.500 |
| | Monomethylol Dimethyl hydantoin (25%) | 0.400 |
| | Perfume K 89-214 | 0.500 |
| Part IV | A 6931 Cosmetic grade chromium hydroxide (50% slurry) | 0.400 |
| | 3506 cosmetic yellow synthetic iron oxide (50% slurry) | 0.335 |
| | | 100.000 |

Component II Non-color Phase

Same as component I. In this phase however, formula amount of pigment is replaced with water.

| | |
|---|---|
| Fill: | |
| Component I | 7 |
| Component II | 93 |
| | 100.0 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A container for dispensing creams, gels, pastes and the like in a solid column wherein fluent material of a predominantly base color has at least on its outer surface random but distinctive streaks and/or areas presenting a marbleized appearance comprising a flexible walled body adapted to contain a supply of said base color material, said body having a discharge outlet at one end, an open-ended tubular member fixed in said body with its outer end in said outlet and extending within the body sufficiently to dispose its inner end within the supply of base color material, means distributed over the internal surface of said member providing a multiplicity of irregular fixed sharp randomly spaced internal surface projections, means defining a space within said body around said member for a supply of fluent different color material, and means providing a plurality of openings in said member adjacent said outlet and upstream of at least some of said projections that are disposed to introduce material from said body space into base material passing through said member before discharge through said outlet, said materials being discharged through said member when the body wall is flexed.

2. A container for dispensing creams, gels, pastes and like fluent materials in a solid column wherein fluent material of a predominantly base color has at least on its outer surface random but distinctive streaks and/or areas presenting a marbleized appearance comprising a flexible walled body adapted to contain a supply of said base color material having a tubular discharge outlet member that projects within the body and is open at its inner end within the supply of base color material so as to axially receive and pass as a column the base color material being dispensed when the tube wall is flexed, means providing a multiplicity of randomly spaced fixed sharp internal surface projections within said outlet member, means defining a space within said body around said outlet member for a supply of fluent different color material, and means providing a plurality of lateral openings in said outlet member constructed and disposed to introduce streams of material from said surrounding body space adjacent the dispensing end of the body into the base color material passing axially through said outlet member upstream of at least some of said projections when the body wall is flexed.

3. A container as defined in claim 2, wherein said outlet member comprises a discharge neck having an open ended tube extending into the interior of said body, said sharp projections being formed on the internal surface of said tube and said lateral openings being formed in the tube wall within said body adjacent said neck.

4. A container as defined in claim 3, wherein said tube is an integral element having a force fit in said neck.

5. A container as defined in claim 2, wherein said sharp projections are randomly disposed over at least the entire internal surface of said outlet member that is downstream of said openings.

* * * * *